US007850432B2

(12) United States Patent
Clough et al.

(10) Patent No.: US 7,850,432 B2
(45) Date of Patent: Dec. 14, 2010

(54) ION PUMP HAVING EMISSION CONTAINMENT

(75) Inventors: Stephen P. Clough, Shakopee, MN (US); Robert Dale Golla, Maple Grove, MN (US)

(73) Assignee: Gamma Vacuum, LLC, Shakopee, MN (US)

( * ) Notice: Subject to any disclaimer, the term of this patent is extended or adjusted under 35 U.S.C. 154(b) by 1126 days.

(21) Appl. No.: 11/531,811

(22) Filed: Sep. 14, 2006

(65) Prior Publication Data

US 2008/0069701 A1 Mar. 20, 2008

(51) Int. Cl.
*F04B 37/02* (2006.01)
*G01N 21/01* (2006.01)

(52) U.S. Cl. ..... 417/48; 250/437

(58) Field of Classification Search ..... 417/48; 250/428, 437

See application file for complete search history.

(56) References Cited

U.S. PATENT DOCUMENTS 3,552,885 A * 1/1971 Bassan ..... 417/152
3,665,236 A * 5/1972 Gaines et al. ..... 378/138
4,295,338 A * 10/1981 Welch ..... 62/55.5
5,646,488 A 7/1997 Warburton
5,727,929 A * 3/1998 Nagai et al. ..... 417/49
6,220,821 B1 4/2001 Kern et al.
6,264,433 B1 7/2001 Spagnonl
6,309,184 B1 * 10/2001 Moraja et al. ..... 417/51
6,411,023 B1 6/2002 Ogura et al.
6,498,344 B1 12/2002 Littlejohn
6,616,417 B2 9/2003 Shen
6,835,048 B2 12/2004 Perkins et al.
2004/0120826 A1 6/2004 Perkins et al.
2006/0045754 A1 3/2006 Lukens

OTHER PUBLICATIONS

"Vacuum Solutions for Electron Microscopy Applications", Brochure by Varian, Inc.,(Jul. 2005), pp. 1-12.

* cited by examiner

*Primary Examiner*—Charles G Freay
(74) *Attorney, Agent, or Firm*—Pauly, DeVries Smith & Deffner, L.L.C.

(57) ABSTRACT

An ion pump having emissions containment. The ion pump includes an anode constructed from a plurality of tubes and a cathode constructed from plates positioned on opposite sides of the anode and positioned apart from the anode. The anode and cathode are positioned within a gastight housing having a gas inlet. A blocking shield assembly is provided within the line of sight between the gas inlet and the cathode. The blocking shield assembly is also provided within the line of sight between the gas inlet and any surface within the ion pump that itself is within the line of sight of the cathode. The blocking shield assembly prevents photons and neutral particles from being emitted from the ion pump.

16 Claims, 7 Drawing Sheets

ION PUMP HAVING EMISSION CONTAINMENT

FIELD OF THE INVENTION

The invention relates to ion pumps for producing high and ultrahigh levels of vacuum within a vacuum chamber. More particularly, the invention relates to the containment of emissions from an ion pump.

BACKGROUND OF THE INVENTION

Ion pumps are used in a variety of scientific and technological applications to create high and ultra high levels of vacuum (i.e., very low absolute pressures) within a vacuum chamber. For example, ion pumps are often used with scanning electron microscopes (SEM), mass spectrometers, Auger electron microprobes, particle accelerators, and a variety of particle beam devices. They are also used in vacuum tube processing, development and production of semiconductor devices, and space simulation. A number of other instruments and apparatuses use ion pumps.

The vacuum level in a vacuum chamber can be characterized by the gas pressure within the chamber. Whereas atmospheric pressure is about $1\times10^{3}$ mbar (750 torr), an application requiring a high or ultra high vacuum level, such as those discussed above, may require a vacuum level on the order of $1\times10^{-5}$ mbar ($7.5\times10^{-6}$ torr) down to $1\times10^{-11}$ mbar ($7.5\times10^{-12}$ torr) or even lower. For comparison, the pressure in interstellar deep space is on the order of $10^{-16}$ torr. Pressures below $1\times10^{-5}$ mbar can be called high vacuum, and pressures below $1\times10^{-8}$ mbar can be called ultra high vacuum.

A vacuum can be created within a chamber with a piston-style pump, a turbo-molecular pump, or other mechanical pump. However, the vacuum level associated with a piston-style mechanical pump is inadequate for applications that require very high or ultra high vacuum pressures. A turbo-molecular pump can produce ultra high levels of vacuum but may exhibit detrimental effects such as mechanical vibration or contamination from pump fluids. Accordingly, mechanical pumps are incapable of producing clean, vibration free high or ultra high vacuum levels required in many applications.

Ion pumps are known in the art for generating high or ultra high vacuum levels within a chamber. Ion pumps do not mechanically pump gases out of a chamber, but rather function by converting gases within a chamber to solids that are then deposited on surfaces within the ion pump, as well as through physisorption of gases (particularly noble gases) on surfaces within the ion pump. According to the law of ideal gasses, the pressure inside of a fixed volume at a fixed temperature is proportionate to the number of gas molecules present. Therefore, by capturing gas molecules and converting or binding them to solids, the gas pressure inside the chamber is reduced.

Ion pumps constructed in a conventional manner have performed successfully in a number of applications. However, it has been found in certain applications that a conventional ion pump does not perform as well as is desired. Improved ion pumps are needed.

SUMMARY OF THE INVENTION

An ion pump is disclosed, where the ion pump has a gastight housing with a gas inlet that is configured to be attached to a vacuum chamber. The ion pump also includes an anode constructed from a plurality of electrically-bonded, open tubes and a cathode constructed from a first plate positioned on one side of the anode and spaced apart from the anode, and a second plate positioned on an opposite side of the anode and spaced apart from the anode. Both the cathode and the anode are inside the housing. One or more magnets are provided to create a magnetic field at the anode. A source is included for providing an electrical potential to the anode. A blocking shield assembly is located within the housing between the cathode and the gas inlet. The blocking shield assembly is configured to block particles generated at the cathode from line-of-sight transmission through the gas inlet. The blocking shield assembly is also configured to block particles, including photons, from being transmitted through the gas inlet that are generated at or reflected from surfaces within the housing that have line-of-sight to the cathode.

The invention may be more completely understood by considering the detailed description of various embodiments of the invention that follows in connection with the accompanying drawings.

Figure 1:
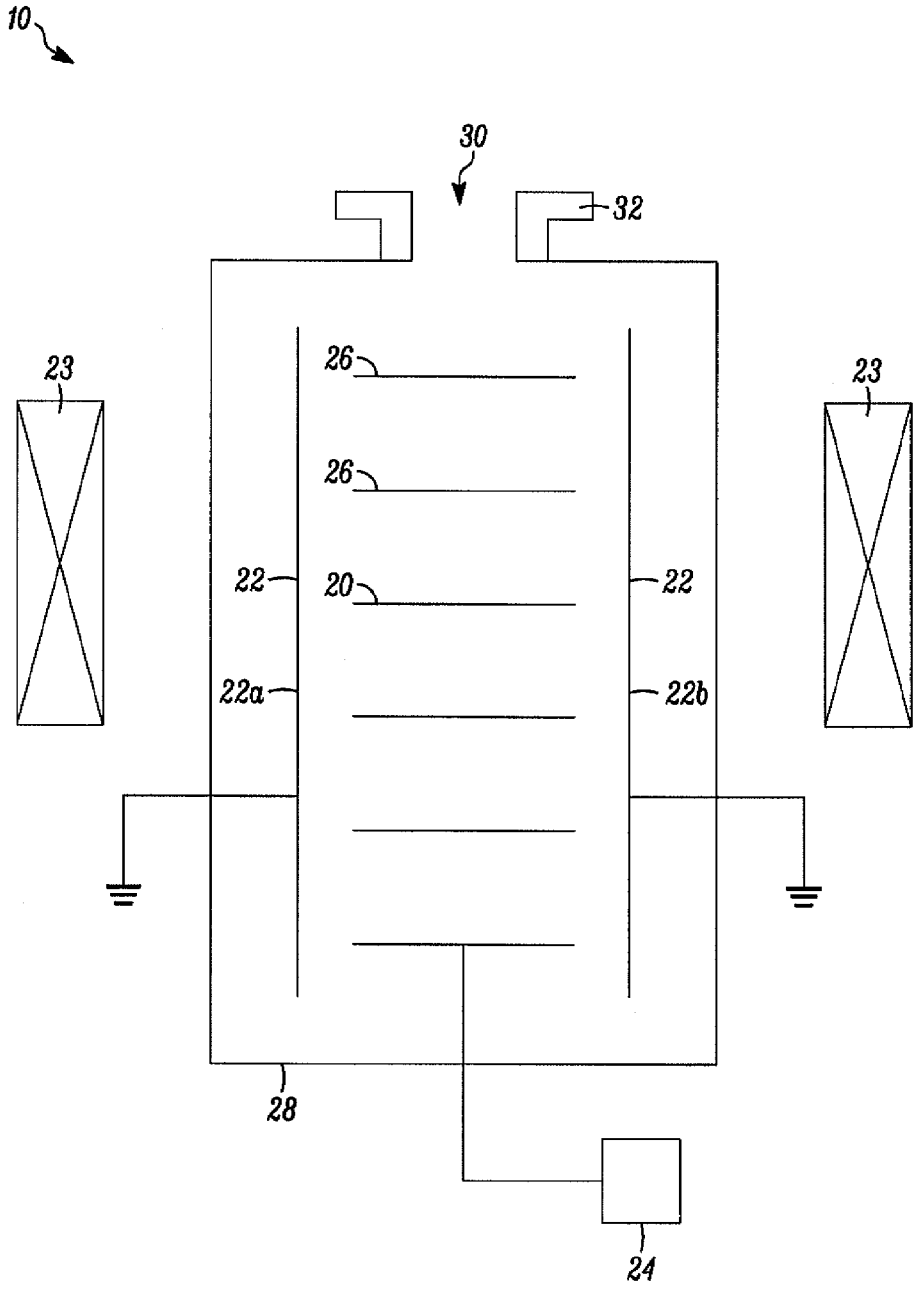
PRIOR ART FIG. 1
FIG. 1 is a schematic showing the basic elements of an ion pump (prior art).

While the invention may be modified in many ways, specifics have been shown by way of example in the drawings and will be described in detail. It should be understood, however, that the intention is not to limit the invention to the particular embodiments described. On the contrary, the intention is to cover all modifications, equivalents, and alternatives following within the scope and spirit of the invention as defined by the claims.

DETAILED DESCRIPTION OF THE INVENTION

A schematic of a typical ion pump 10 is shown in FIG. 1. Such an ion pump includes an anode 20, a cathode 22, and a source 24 for providing an electrical potential to the anode 20. Anode 20 is typically constructed from a plurality of tubes 26 that are electrically bonded to each other. In one example embodiment, each tube 26 may be roughly 0.75 inches in diameter and 1 inch long. However, many other sizes are usable. In one example embodiment, anode 20 is constructed from 40 such tubes in an array that is five tubes wide by eight tubes long. In one embodiment, tubes 26 are cylindrical, having a round cross section, but other usable embodiments exist. For example, tubes 26 could have a square, hexagonal, or other shape of cross section and also be usable.

Cathode 22 typically includes a first plate 22*a* positioned on one side of anode 20 and spaced apart from anode 20, and a second plate 22*b* positioned on an opposite side of anode 20 and spaced apart from anode 20. Cathode 22 is typically constructed from titanium or tantalum, or a combination of these two metals. Cathode 22 is typically electrically grounded.

Source 24 is configured to provide an electrical potential to anode 20 of about 3.5 to 7 kV. Because anode 20 is at a significantly higher electrical potential than cathode 22 or other surrounding components, it is desired that any supporting members or other components in contact with anode 20 be constructed from non-conducting materials.

Ion pump 10 further includes a gas tight housing 28 in which anode 20 and cathode 22 are contained, as well as any necessary electrical leads from source 24. Housing 28 is typically configured for attachment to a device having a vacuum chamber, such as a scientific or technological instrument or apparatus. For example, housing 28 may have a gas inlet tube 30 having a flange 32 that is fastened to the device and is configured to form a gastight seal with the vacuum chamber of the device. In one embodiment, a copper gasket is provided between flange 32 and a corresponding surface on the device, where the copper gasket deforms slightly under assembly loads to create a gastight seal.

One or more magnets 23 are provided for creating a magnetic field in and around anode 20. In one embodiment, magnets 23 are provided outside of housing 28. Many embodiments of magnet 23 are usable.

In operation, ion pump 10 is attached to the device having a vacuum chamber and forms a gastight seal therebetween. Preferably, a mechanical vacuum pump is provided to evacuate the bulk of the gases within the system consisting of the device vacuum chamber and ion pump 10. This process is called rough pumping, and preferably the system is rough pumped to about $1\times10^{-4}$ mbar prior to the utilization of the ion pump. Source 24 is then activated and provides an electrical potential to anode 20. This electrical potential of anode 20 causes an electron cloud to form within tubes 26. In most embodiments, a magnetic field is provided to ion pump 10, such as by means of external magnets 23, that causes the electrons within the electron cloud to move along a helical path within tubes 26. A helical path is advantageous because it increases the distance that an electron must travel through the anode before reaching the cathode, thereby increasing the amount of time that an electron is contained within the anode tube. Electrons tend then to travel from the high electrical potential of the anode to the low electrical potential of the cathode along this helical path. Gas molecules from within the ion pump and the vacuum chamber diffuse into the region of cathode 22 and anode 20 and its associated tubes 26. These gas molecules have a high probability of colliding with an electron within the electron cloud, particularly where a magnetic field is provided to cause the electrons to move along a long, helical path. A collision between an electron and a gas molecule tends to cause the gas molecule to ionize, where one or more electrons in the outer valence of the gas molecule are separated from the molecule. The electrons that are separated from the gas molecule become part of the electron cloud, and the gas molecule becomes a positively charged ion. Because the ionized gas molecule now has an electrical charge, it tends to be strongly attracted toward the electrically grounded cathode according to what is known as the Lorenz force.

The positively charged gas ions are accelerated toward the grounded cathode at very high velocities and with very high energies up to the potential applied to the anode. The impact energy of the gas ion into the cathode causes cathode atoms to break off from the cathode and be expelled away from the cathode in a process called sputtering. This tends to expose fresh cathode surfaces and to cause cathode material to be distributed throughout the ion pump. Simultaneously, when reactive gas ions such as oxygen, nitrogen, or carbon dioxide strike the cathode or cathode material within the ion pump, these ions will likely chemically combine with an atom of cathode material by sharing an electron with the cathode material atom. The newly formed molecule will either adhere to the cathode or deposit onto a surface within the ion pump, thereby capturing and containing the gas molecule. Non-reactive gas ions such as noble gases like helium and argon may be driven into the cathode by the force associated with their very high impact energy, and then will tend to become embedded as sputtered cathode material redeposits on the cathode. Non-reactive gas ions may also reflect off of the cathode at high velocities. These reflected molecules will tend to be neutrally charged because they often exchange an electron upon impact with the cathode, and will travel at high velocities away from the cathode, possibly becoming buried within another surface within the ion pump. In this way, gas molecules are pumped out of the space within the ion pump and vacuum chamber and captured on the cathode or other surfaces, causing a reduction of pressure.

One issue associated with the operation of an ion pump is how much time it takes to achieve a desired pressure within the vacuum chamber. Excessive amounts of time to evacuate a chamber are generally not desirable because it can lead to a loss of productivity from the device or instrument that uses the ion pump. The rate at which an ion pump evacuates a chamber is most often limited to the rate at which gas molecules can enter the pump. In a gas at a constant volume and temperature, a lower gas pressure equates to a lower number of gas molecules or atoms present and hence a lower molecular gas density. At higher pressures such as the initial pressure when pumping commences (typically after rough pumping), the pressure differential of the gas between the anode/cathode region and the rest of the pump is sufficient to cause gas to be drawn into the anode/cathode region as the gas flows from a region of relatively high pressure to a region of relatively low pressure. However, as the pressure is reduced through the operation of the ion pump, the pressure differential mechanism becomes less and less effective at transporting gas into the anode/cathode region because the absolute difference in pressure is smaller and the gas molecular density is low. Instead, at low pressures the gas molecules are transported primarily through random motion. Gas molecules have a velocity where the magnitude of the velocity is associated primarily with the temperature of the gas. Gas molecules move along straight paths, colliding with other gas molecules and surfaces within their path. These collisions cause the molecules to rebound along different trajectories. In this way, gas molecules tend to move about within the ion pump. Probability dictates that eventually the gas molecules will travel through random motion to the anode/cathode region, where they can be pumped and removed. However, this process can be slow, particularly if the ion pump is not configured to allow gas molecules to readily travel into the pump. It is therefore desired that an ion pump be configured to allow gas molecules to travel into the pump quickly and efficiently.

A second issue associated with the operation of an ion pump is the potential for particle emissions that originate in the ion pump to be transmitted to the vacuum chamber of the device or instrument. Any emitted particles may contaminate the vacuum chamber and interfere with the operation of the device or instrument. While it is generally known that electrons and cathode material ions are generated by the impact of gas ions against the cathode, the inventors have determined that the sputtering process that occurs at the cathode also tends to generate a significant quantity of neutral material, in addition to electrons, gas ions, and cathode material ions, that can be emitted from the ion pump. This neutral material may include neutral atoms or molecules of the cathode material, as well as photons. The term "emitted particles" is used to refer to electrons, gas ions, cathode material ions, cathode material neutral atoms or molecules, and photons. Although photons are not universally considered particles, we will include photons in the terms "emitted particles," "particle emissions," "particles," or "neutral particles" for simplicity.

A particular concern is that particle emissions may be generated by the ion pump and transferred into the vacuum chamber that is attached to the ion pump. The inventors have determined, however, that conventional ion pumps tend to have very low direct emissions of electrons or other negatively charged particles because any negatively charged particles present within the ion pump are strongly attracted to the positive potential of the anode. Instead, the inventors have determined that the high energy impact that occurs when gas ions impact the cathode can release electromagnetic wave energy from the cathode in the form of photons, particularly photons having a wavelength characterized as being x-ray radiation. In addition, other neutral particles are formed upon the impact of a gas ion with the cathode. Because photons and other neutral particles do not have an electrical charge, they are unaffected by the electric field created around the anode and are free to travel out of the ion pump either through motion along a direct line-of-sight path or through impact with surfaces within the ion pump. These impacts may cause reflection of the particle or generation of other particles, especially additional photons. The presence of photons themselves within the vacuum chamber may or may not be harmful; however, inside the vacuum chamber the photons tend to collide with gas molecules or components of the vacuum chamber. These collisions may result in the significant liberation of low-energy electrons. The presence of these electrons, along with any other neutral or charged particles that are emitted from the ion pump, is generally harmful to the operation of the apparatus or instrument.

Figure 2:
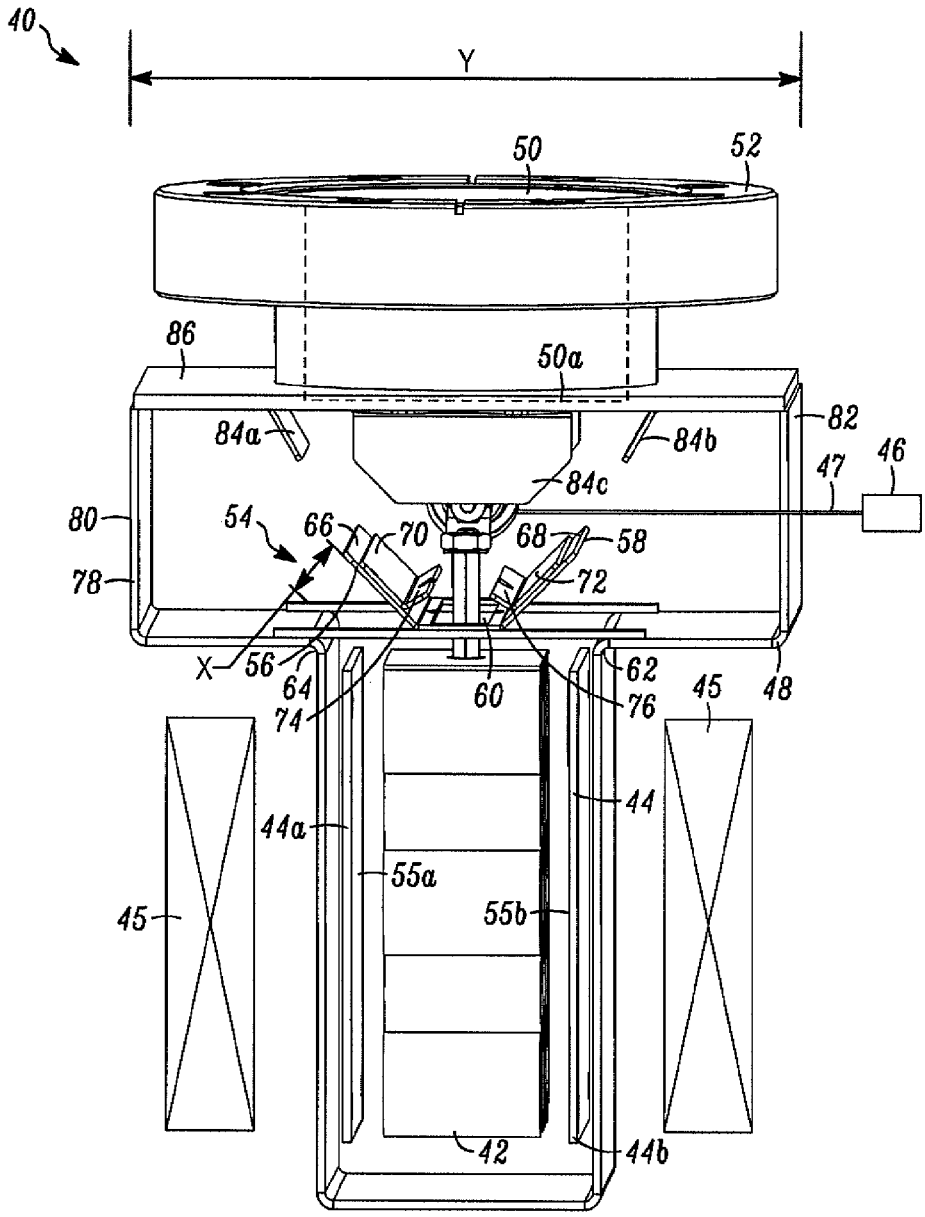
FIG. 2 is a cross-sectional view of an ion pump having emission containment features constructed according to the principles of the present invention.

Accordingly, the inventors have developed an ion pump that is configured to reduce and contain the particle emissions that would otherwise be emitted from the ion pump. An ion pump 40 constructed according to the principles of the present invention is shown in FIG. 2. Ion pump 40 includes an anode 42, cathode 44, and source 46 for providing an electrical potential to anode 42. Source 46 applies a charge to anode 42 by way of conductor 47. One or more magnets 45 are provided to create a magnetic field at and around anode 42. Cathode 44 includes a first cathode plate 44*a* and a second cathode plate 44*b*. Ion pump 40 further includes a housing 48 that contains anode 42 and cathode 44, and where housing 48 is generally gas tight except at a gas inlet 50. Housing 48 further includes a flange 52 that is configured for gastight attachment to a vacuum chamber. In the embodiment of FIG. 2, gas inlet 50 is cylindrical; however, other configurations are usable. Gas inlet 50*a* is defined as a planar cross-section of gas inlet 50 at the end of gas inlet 50 that is closest to cathode 44 and anode 42. Ion pump 40 functions generally as described above in association with ion pump 10.

Ion pump 40 further includes features to contain particle emissions from the ion pump 40. Ion pump 40 includes a blocking shield assembly 54 within the housing 48 between the cathode 44 and the gas inlet 50. Blocking shield assembly 54 is configured to block particles generated at the cathode 44 from line-of-sight transmission through the gas inlet 50, and also to block particles generated at or reflected from surfaces within the housing 48 that have line of sight both to the cathode 44 and to the gas inlet 50. Blocking shield assembly 54 is preferably electrically grounded and therefore is electrically neutral.

Blocking shield assembly 54 advantageously blocks direct line-of-sight emissions from the cathode 44, as well as blocking emissions that are generated at or reflected from surfaces within the housing 48 that have a line of sight path to the cathode 44 and to the gas inlet 50. In other words, blocking shield assembly 54 blocks direct particle emissions and secondary particle emissions generated at or reflected from surfaces having line of sight to the cathode 44 and the gas inlet 50. It is also possible that particles that are generated at the cathode 44 could exit the gas inlet 50 through multiple interactions with various surfaces within ion pump 40. However, every time a photon or neutral particle encounters a surface, only a small percentage of the photons or neutral particles result in the generation or reflection of a particle from the surface, the remainder reacting with the surface or otherwise being dissipated. Therefore, the probability of a photon or neutral particle surviving two or more theoretical interactions is very low. Accordingly, it is generally not necessary to configure blocking shield assembly 54 to block paths that would require two or more interactions to travel between the cathode 44 and gas inlet 50.

Many embodiments of blocking shield assembly 54 are usable. One usable embodiment of blocking shield assembly is depicted in FIG. 2. This configuration is adapted to the particular embodiment of ion pump 40 shown in FIG. 2. Other ion pump embodiments will require a blocking shield assembly that is configured according to the principles taught herein. For example, blocking shield assembly 54 will have to be configured for the particular dimensions and orientation of the gas inlet 50 and housing 48, as well as the orientation and relationship of the cathode 44 and anode 42 to the gas inlet 50.

In FIG. 2, blocking shield assembly 54 is constructed so that there is no line-of-sight (i.e., straight) path from the entrance to the gas inlet 50*a* to any portion of the active surfaces 55*a*, 55*b* of the cathode 44. The active surfaces 55*a*, 55*b* of cathode 44 are defined as only the surfaces of the cathode that face the anode 42. The other surfaces of cathode 44, such as the end surfaces and the surfaces that face away from the anode, are not active surfaces because electrons and ions from within the anode tubes do not strike these surfaces. Blocking shield assembly 54 is also configured so that there is no line-of-sight path from any surface within the housing 48 that has a line-of-sight path to the active surface of the cathode. In other words, blocking shield assembly 54 is configured to prevent straight line transmission from the cathode active surface to the gas inlet 50*a*, as well as transmission from the cathode active surface to the gas inlet 50*a* through a single interaction with any surface within the ion pump.

As shown in FIG. 2, blocking shield assembly 54 includes a first cathode blocking shield 56 that forms an angled relationship with respect to first cathode plate 44*a* or a plane parallel to either cathode plate. First blocking shield 56 is configured to block direct transmission of particle emissions from first cathode plate 44*a* to gas inlet 50*a*, where the configuration of first blocking shield 56 depends on the orientation of the gas inlet 50*a*, housing 48, cathode plate 44*a*, and anode 42. It should be noted that anode 42 itself serves to block direct lines of sight from a significant portion of cathode 44, so that first blocking shield 56 only needs to be configured to block paths that are not blocked by anode 42.

Figure 3:
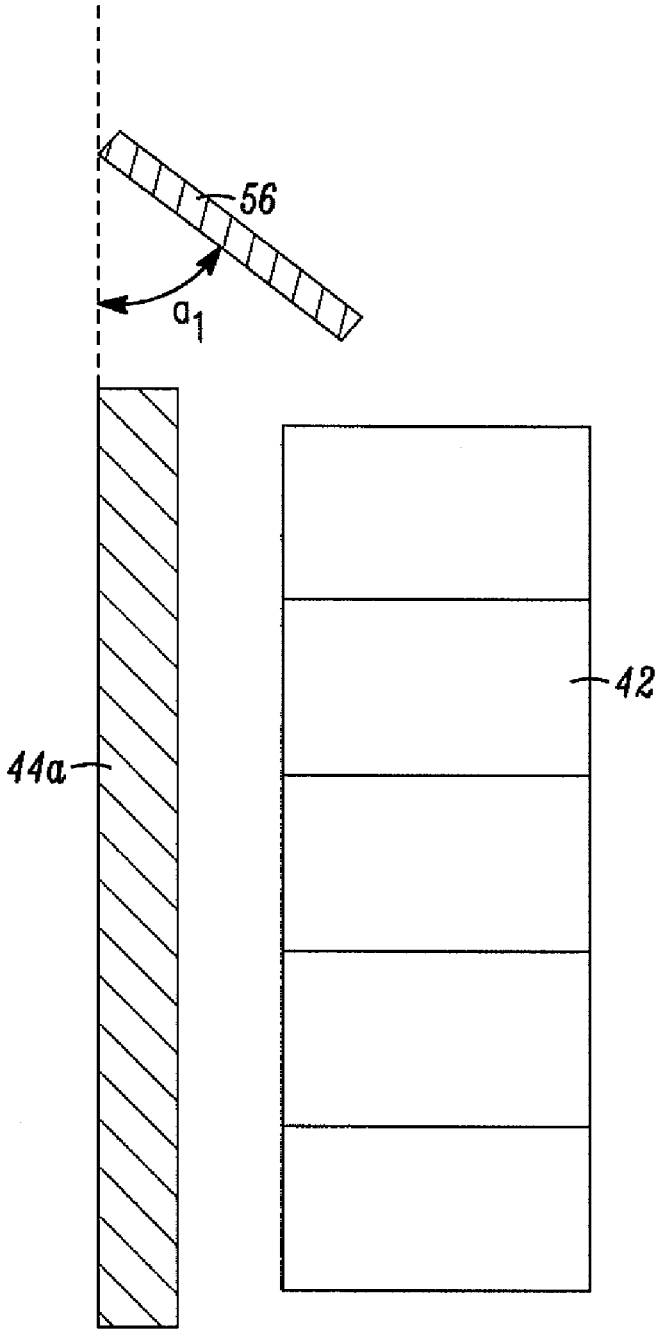
FIG. 3 is a close-up cross-sectional view of the blocking shield of FIG. 2.

The embodiment of the first cathode blocking shield 56 depicted in FIG. 2 is generally planar, however, other configurations or geometries could also be used. A close-up cross-sectional view of cathode plate 44*a*, anode 42, and first blocking shield 56 is shown in FIG. 3. The angled relationship between first cathode blocking shield 56 and first cathode plate 44*a* is indicated in FIG. 3 by angle $\alpha_1$. In one embodiment, the first cathode blocking shield 56 defines an angle $\alpha_1$ of 45 degrees with respect to the plane of the first cathode plate 44*a*, and the first cathode blocking shield 56 extends along an edge of the first cathode plate.

Blocking shield assembly 54 further includes a second cathode blocking shield 58 that forms an angled relationship with respect to second cathode plate 44*b*. Second blocking shield 58 is constructed according to the same principles of construction of first blocking shield 56. The angle between second cathode plate 44*b* and second cathode blocking shield 58 may be designated as $\alpha_2$. The second cathode blocking shield 58 is generally planar, however, other configurations or geometries could also be used. In one embodiment, the second cathode blocking shield 58 defines an angle $\alpha_2$ of 45 degrees with respect to the plane of the second cathode plate 44*b*, and the second cathode blocking shield 58 extends along an edge of the second cathode plate 44*b*. Both first blocking shield 56 and second blocking shield 58 extend sufficiently that there is no line of sight from the active surfaces 55*a*, 55*b* of cathode plates 44*a*, 44*b* to the gas inlet 50*a*. In another embodiment, angle $\alpha_1$, is generally no less than 10 degrees and no more than 80 degrees, and angle $\alpha_2$ is generally no less than 10 degrees and no more than 80 degrees.

As described above, it is desirable to control emissions from the ion pump from surfaces within the ion pump that have line of sight both to the gas inlet 50*a* and to the active surfaces of cathode plates 44*a*, 44*b*. These surfaces can be called secondary particle emission surfaces. Two secondary particle emission surfaces of concern are the surfaces 66, 68 of blocking shields 56, 58, respectively, that face inlet opening 50. Depending on the configuration, a line of sight can exist between an active surface of a cathode plate 44*a* or 44*b* and surface 66 or 68 due to the presence of opening 60. To prevent photons and neutral particles from traveling from a cathode 44*a* or 44*b*, through opening 60, to surface 66 or 68, and then reflecting or generating additional particles that can travel through opening 50, the blocking shield assembly 54 further includes blocking shields 70, 72. Blocking shields 70, 72 include projections 74, 76 that project away from blocking shields 56, 58. Blocking shields 70, 72 are configured to shield those portions of blocking shields 56, 58 that form a secondary particle emission surface having line of sight both to gas inlet 50*a* and to the active surface of cathode plates 44*a*, 44*b*. Many embodiments of blocking shields 70, 72 are usable. In one embodiment, blocking shield projections 74, 76 are orthogonal to blocking shields 56, 58, respectively.

Another region of possible reflection surfaces is located in the upper region 78 of housing 48. Upper region 78 is the portion of housing 48 between the cathode/anode assembly and gas inlet 50*a*. Upper region 78 includes upper side walls 80, 82. In a conventional ion pump, upper region 78 is generally relatively narrow. However, upper side walls 80, 82 can serve as secondary particle emission surfaces that have line of sight between both the cathode 44 and gas inlet 50. By increasing the width of upper region 78, the amount of secondary particle emission surface can be minimized. Specifically, dimension "y" shown in FIG. 2 can be increased to minimize the secondary particle emission surface that has line of sight both to the gas inlet 50 and cathode 44. In this way, the generation or reflection of photons and neutral particles from the cathode 44 into the gas inlet 50 can be minimized or eliminated.

In some applications, it may not be feasible to increase to width of the upper region 78 sufficiently to eliminate reflection from upper side walls 80, 82. Thus, there may be some portion of upper side walls 80, 82 that constitutes a reflection surface that has a line of sight both to the gas inlet 50*a* and to the active surfaces 55*a*, 55*b* of cathodes 44*a*, 44*b*. In this case, it is desired that there be at least one inlet blocking shield 84 positioned immediately adjacent to the gas inlet 50*a*, where the inlet blocking shield 84 is configured to block photons and neutral particles from transmission through the gas inlet 50*a* from surfaces within the housing 48 that have line-of-sight to the cathode 44. In the embodiment depicted in FIG. 2, the inlet blocking shield includes four portions 84*a*, 84*b*, 84*c*, 84*d* positioned equally (at right angles to each other) surrounding the gas inlet 50*a*. Blocking shield 84*d* is not visible in FIG. 2. Each of the four portions 84*a*, 84*b*, 84*c*, 84*d* includes at least one portion that is angled with respect to a top wall 86, where top wall 86 is generally parallel to the plane defined by gas inlet 50*a*.

Figure 4:
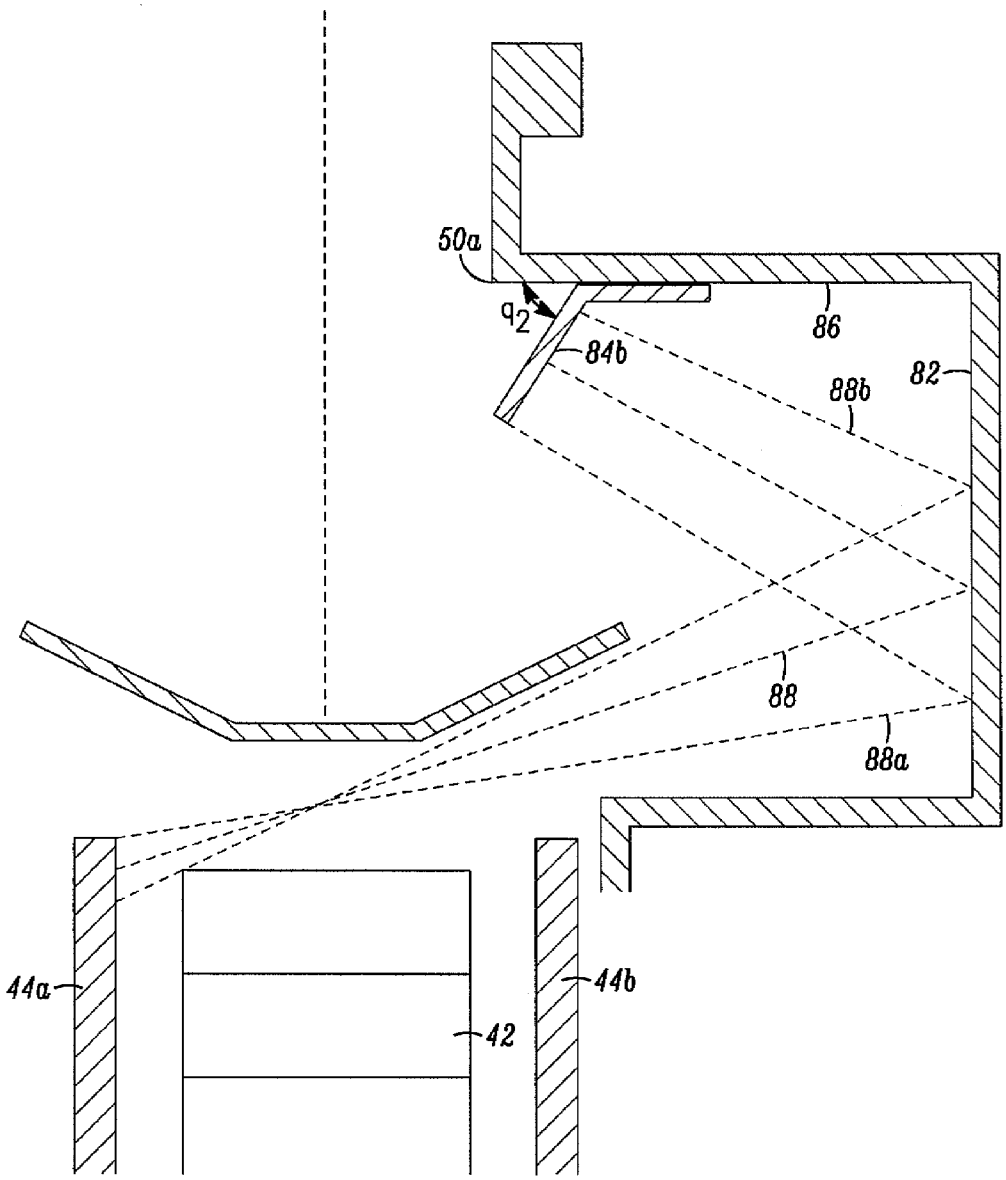
FIG. 4 is a close-up cross-sectional view of the inlet blocking shield of FIG. 2.

FIG. 4 shows a close-up sectional view of one portion 84*b*. As shown in FIG. 4, portion 84*b* forms angle $\theta_2$ with respect to top wall 86. Portions 84*a*, 84*c*, 84*d* each form analogous angles $\theta_1$, $\theta_3$, $\theta_4$, respectively, with respect to top wall 86. As shown in FIG. 4, portion 84*b* is constructed to block photons and other neutral particles emitted or reflected from the upper side wall 82 so as to prevent such photons and neutral particles from entering gas inlet 50*a*. One line of sight path of photons and other neutral particles is designated path 88 in FIG. 4. Photons and other neutral particles emitted from cathode plate 44*a* travel in a straight, line-of-sight path 88 to side wall 82, where they may reflect toward gas inlet 50*a* or may generate additional particles that travel toward gas inlet 50*a*, but are blocked by portion 84*b*. The actual configuration of each of portions 84*a*, 84*b*, 84*c*, 84*d* will vary depending on the actual configuration of the components of ion pump 40.

To determine the proper configuration of portions 84*a*, 84*b*, 84*c*, 84*d*, it is necessary to determine the range of line-of-sight paths from each side wall surface to the gas inlet and to the active surface of the cathode. The range of line-of-sight paths will vary depending, for instance, on the geometry of housing 48, gas inlet 50, anode 42, cathode 44, and other components. For example, in FIG. 4, the range of line of sight paths would be bounded at one limit by a first path 88*a* that originates at an endmost portion of cathode 44*a*, travels at a relatively shallow angle with respect to the horizontal, and reflects off of wall 82 toward a far end of gas inlet 50*a*. The range of line of sight paths would be bounded at another limit by a second path 88*b* that originates further from the end of cathode 44*a*, travels past a corner of anode 42 and projects at a relatively steeper angle with respect to the horizontal, reflecting off of wall 82 toward a near end of gas inlet 50*a*. Portion 84*b* should be configured to block each possible line of sight path from side wall 82 that has line of sight to the cathode 44*a*, and therefore should be configured to block each of the limiting paths 88*a*, 88*b*. Portion 84*b* is configured to block each possible line of sight path by selecting the angle $\theta_2$ with respect to top wall 86, the length that portion 84*b* projects from top wall 86, and the relative location of portion 84*b* with respect to gas inlet 50*a*. Each of the other portions 84*a*, 84*c*, 84*d* are configured according to a similar analysis. In one embodiment, portions 84*a*, 84*b*, 84*c*, 84*d* of inlet blocking shield 84 define angles $\theta_1$, $\theta_2$, $\theta_3$, $\theta_4$ respectively of at least 10 degrees and not more than 170 degrees. The inlet blocking shield 84 is generally not configured, however, to block particles generated at the cathode 44 from direct line-of-sight transmission through the gas inlet 50*a*.

In addition to being configured to contain emissions from ion pump 40, first blocking shield 56 and second blocking shield 58 are also configured to minimize the resistance to flow or travel of gas molecules into ion pump 40. Minimizing the resistance of gas molecules to flow into the pump is also called maximizing the conductance of gas molecules into the pump. This is important because lower resistance, or higher conductance, reduces the amount of time required to evacuate the vacuum chamber to a given pressure level and also can result in a lower minimum pressure level within the vacuum chamber.

Figure 7:
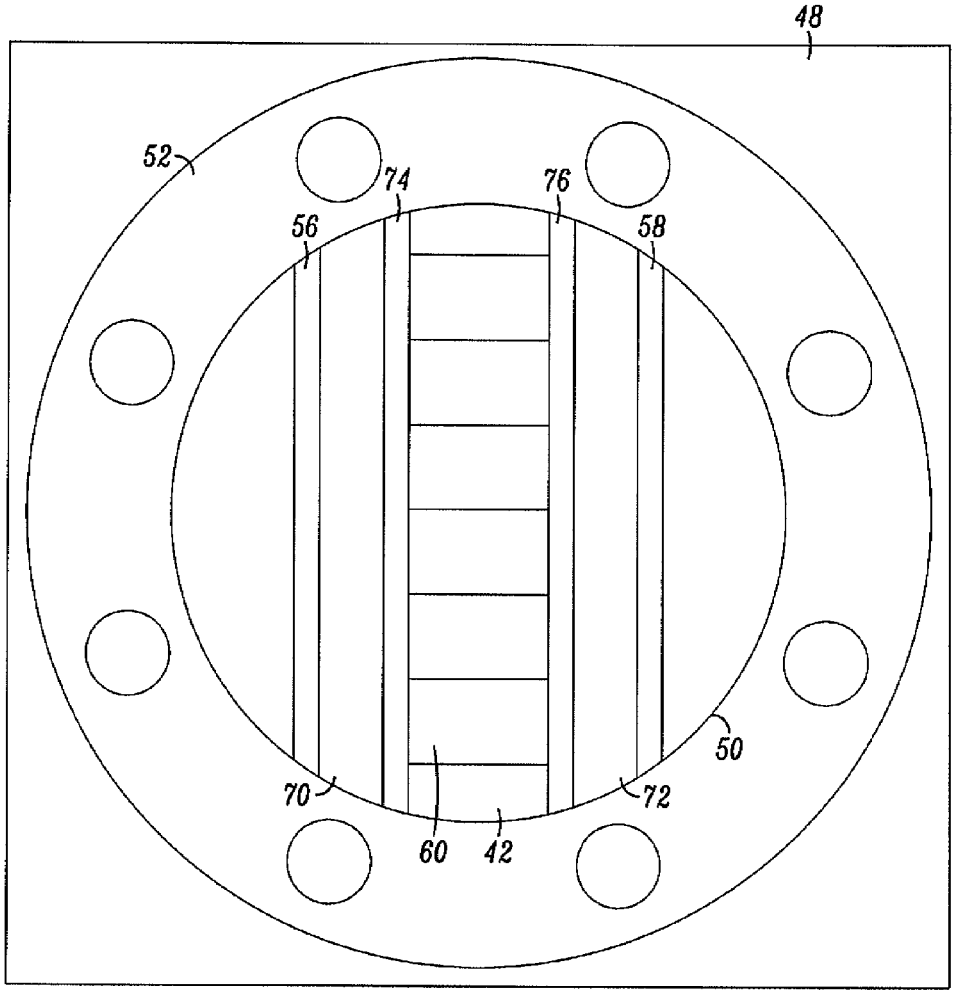
FIG. 7 is a top view of the ion pump of FIG. 2.

A first feature for maximizing conductance is the provision of an opening 60 between first blocking shield 56 and second blocking shield 58, as shown in FIG. 2. Opening 60 provides a direct flow path from the gas inlet 50 to the anode 42. The opening 60 therefore allows line-of-sight transmission from at least a portion of the gas inlet to at least a portion of the anode. This is particularly important under conditions of very low pressures, where gas molecules are transmitted to the anode 42 primarily by way of random motion of the gas molecules. Having a straight flow path available from gas inlet 50 to anode 42 increases the likelihood and rate at which gas molecules will be transmitted to anode 42. The size of opening 60, however, is the product of a compromise. On one hand, opening 60 is preferably as wide as possible to maximize gas conductance; however, on the other hand, opening 60 should not be so wide that a direct line of sight exists between a cathode plate 44*a*, 44*b* and the gas inlet 50. Opening 60 is apparent in the top perspective view of FIG. 7, showing a view looking into gas inlet 50. As seen in FIG. 7, a portion of anode 42 is visible through gas inlet 50 but active surfaces 55*a*, 55*b* of cathode 44 are not visible on account of blocking shields 56, 58 and 70, 72, including projections 74, 76, and also on account of the anode 42 itself.

Additional features associated with maximizing the conductance of gas into the ion pump are the angles $\alpha_1$, $\alpha_2$ of the first and second blocking shields 56, 58 with respect to cathode plates 44*a*, 44*b*. For a fixed base point, the angles $\alpha_1$, $\alpha_2$ of blocking shields 56, 58 affect the flow area between first and second blocking shields 56, 58 and edges 64, 62, respectively, of housing 48. The flow area is a function of the distance between, for example, blocking shield 56 and corner 64, labeled in FIG. 2 as dimension "x." Where the angles $\alpha_1$, $\alpha_2$ between first and second blocking shields 56, 58 and cathode plates 44*a*, 44*b* are increased (that is, shields 56, 58 approach being perpendicular to cathode plates 44*a*, 44*b*), the flow area between first and second blocking shields 56, 58 and corners 64, 62, respectively, decreases. Thus, the design of first and second blocking shields 56, 58 is also the product of compromise. On one hand, larger angles $\alpha_1$, $\alpha_2$ will tend to have a greater effect on preventing emission from the cathode plates, by reflecting emissions into the vicinity of the cathode or into a wall of housing 48 that is not within the line of sight of gas inlet 50, but on the other hand, smaller angles $\alpha_1$, $\alpha_2$ will tend to provide greater gas conductivity from the gas inlet 50 to the anode 42. The ideal angles $\alpha_1$, $\alpha_2$ of first and second blocking plates 56, 58 are the largest angles that do not allow emissions to have lines of sight from the active surfaces of the cathodes to the gas inlet. In one usable embodiment, the angle $\alpha_1$, $\alpha_2$ of each of the first and second blocking plates 56, 58 with respect to first and second cathode plates 44*a*, 44*b*, respectively, is 45 degrees. In another embodiment, the angles $\alpha_1$, $\alpha_2$ of each of the first and second blocking plates 56, 58 with respect to first and second cathode plates 44*a*, 44*b*, respectively, are generally at least 10 degrees and not more than 80 degrees.

Figure 5:
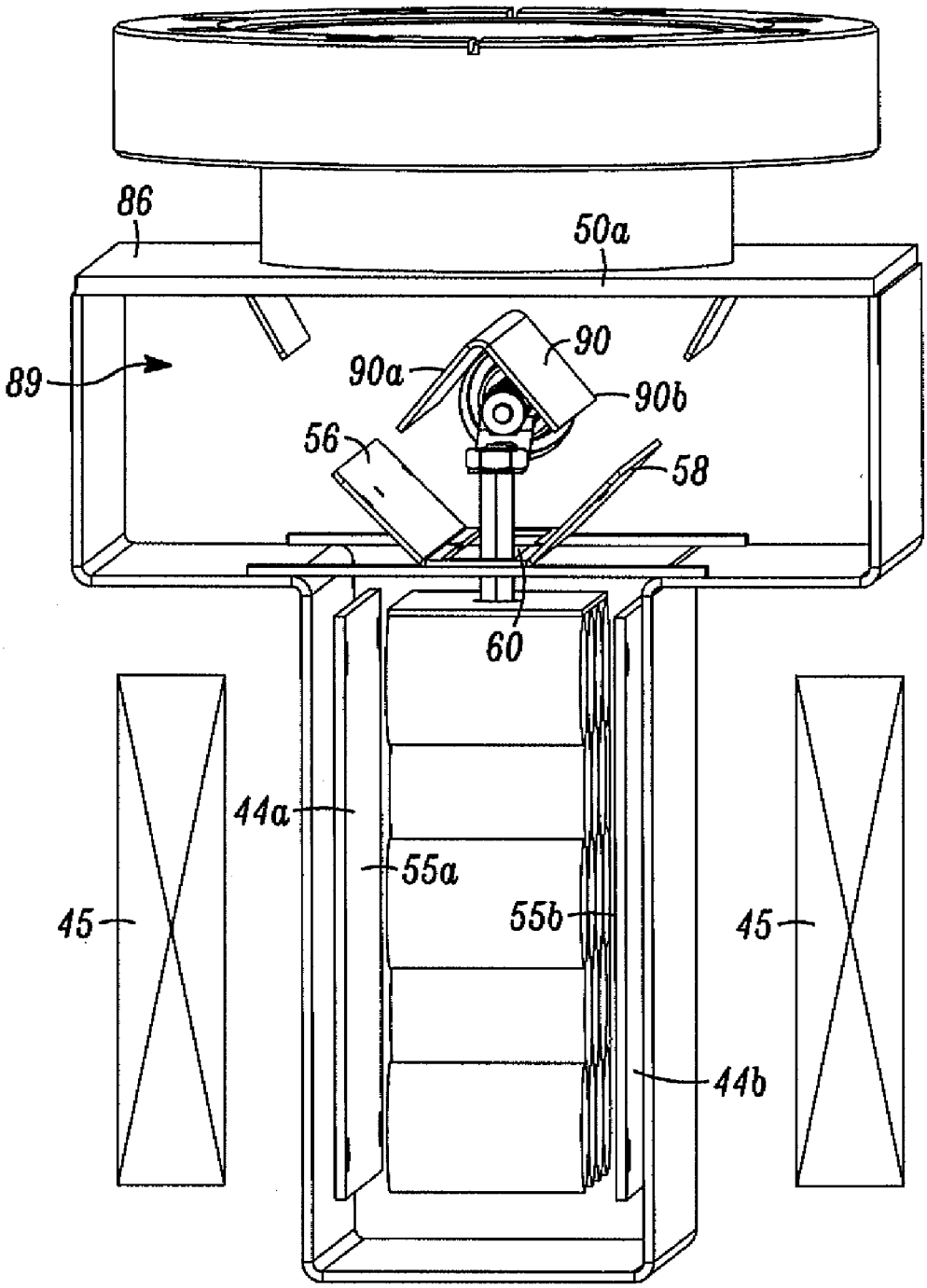
FIG. 5 is a cross-sectional view of an alternative embodiment of an ion pump having emission containment features.

Many embodiments of a blocking shield assembly are usable. Another usable embodiment, blocking shield assembly 89, is depicted in FIG. 5. The embodiment depicted in FIG. 5 is similar to the embodiment depicted in FIG. 2. However, it does not include blocking shields 70, 72. Instead, the embodiment of FIG. 5 includes V-shaped blocking shield 90 that is configured to prevent transmission of photons and other neutral particles that travel from cathode 44 through opening 60, and reflect off or generate additional particles at blocking shield surfaces 66 and 68 which have line of sight to gas inlet 50*a*. Blocking shield 90 is positioned between blocking shields 56, 58 and gas inlet 50*a*, and is preferably configured to reflect photons and neutral particles away from gas inlet 50*a*. Blocking shield 90 is also preferably configured so as to provide the greatest amount of area between the ends 90*a*, 90*b* of blocking shield 90 and blocking shields 56, 58 in order to maximize the conductivity of gases through opening 60.

Figure 6:
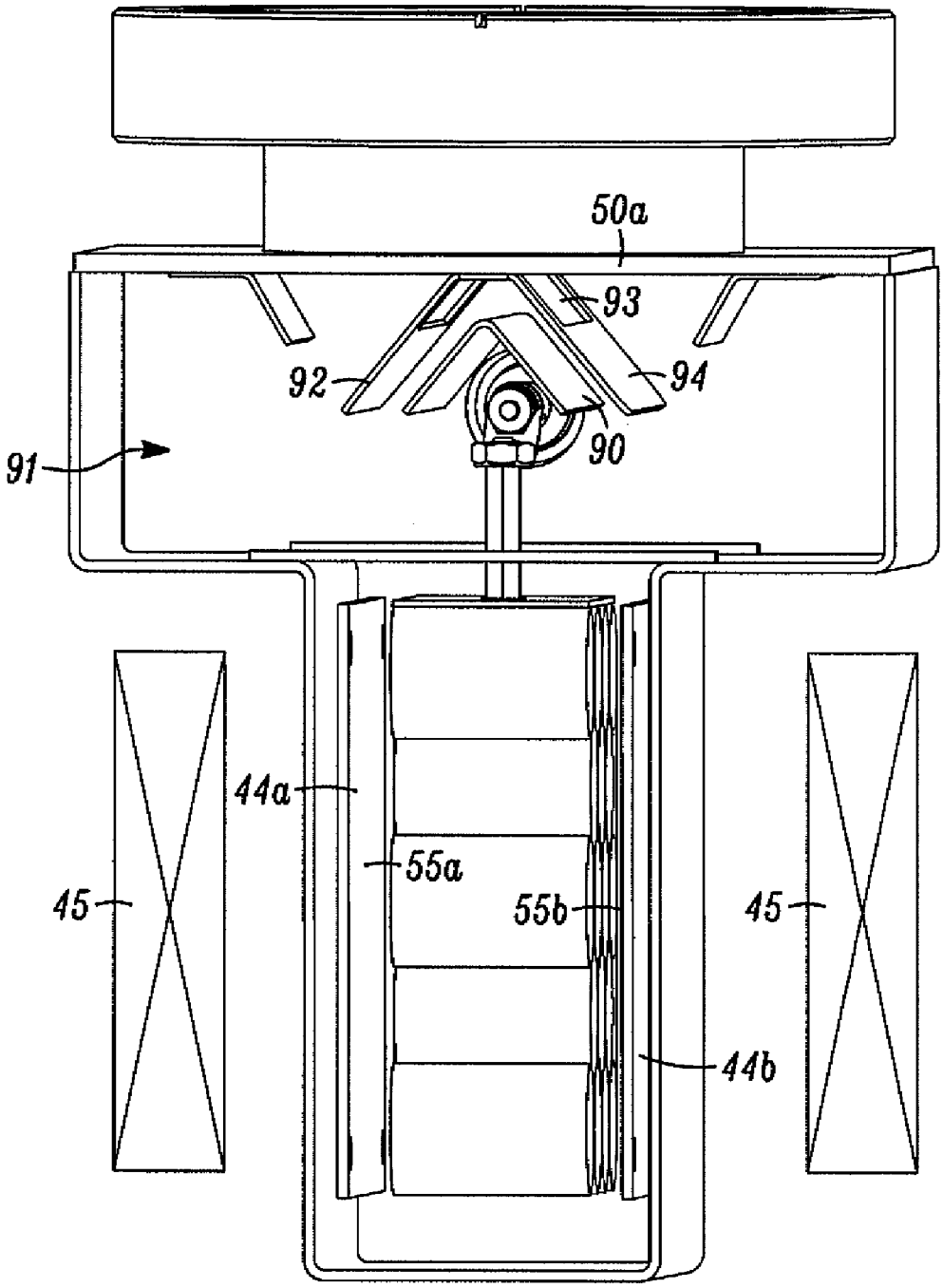
FIG. 6 is a cross-sectional view of an additional alternative embodiment of an ion pump having emission containment features.

Yet another embodiment of a blocking shield assembly is depicted in FIG. 6. The embodiment of a blocking shield assembly 91 depicted in FIG. 6 is similar to the embodiment depicted in FIG. 2, however, blocking shields 56, 58, 70, 72 are replaced with a V-shaped blocking shield 90 and blocking shields 92, 94. Blocking shields 90, 92, 94 are configured to block direct line-of-sight transmission from the active surfaces of cathode plates 44*a*, 44*b* through gas inlet 50*a*. Blocking shields 90, 92, 94 also define an opening 93 that allows for increased gas conductance. Blocking shield 90 is configured to block photons and neutral particles from the cathode 44 that would otherwise strike blocking shields 90, 92 and be reflected into or generate additional particles that may travel to gas inlet 50*a*.

The present invention should not be considered limited to the particular examples described above, but rather should be understood to cover all aspects of the invention as fairly set out in the attached claims. Various modifications, equivalent processes, as well as numerous structures to which the present invention may be applicable will be readily apparent to those of skill in the art to which the present invention is directed upon review of the present specification. The claims are intended to cover such modifications and devices.

The above specification provides a complete description of the structure and use of the invention. Since many of the embodiments of the invention can be made without parting from the spirit and scope of the invention, the invention resides in the claims.

What is claimed is:

1. An ion pump comprising:

a gastight housing defining a gas inlet, wherein the housing is configured for attachment to a vacuum chamber;

an anode comprising a plurality of electrically-bonded, open tubes within the housing;

a cathode comprising a first plate positioned on one side of the anode and spaced apart from the anode and a second plate positioned on an opposite side of the anode and spaced apart from the anode;

one or more magnets for creating a magnetic field at the anode;

a source for providing an electrical potential to the anode; and a blocking shield assembly within the housing between the cathode and the gas inlet configured to block particles generated at the cathode from direct line-of-sight transmission through the gas inlet, wherein the blocking shield assembly is further configured to block particles from transmission through the gas inlet that are generated at or reflected from surfaces within the housing that have line-of-sight to the cathode.

2. The ion pump of claim 1, wherein the blocking shield assembly further comprises:

a first cathode blocking shield oriented at an angled relationship with respect to the first cathode plate, wherein the first cathode blocking shield defines an angle of at least 10 degrees and not more than 80 degrees with respect to a plane parallel to the first cathode plate, wherein the first cathode blocking shield extends along one edge of the first cathode plate.

3. The ion pump of claim 2, wherein the blocking shield assembly further comprises:

a second cathode blocking shield oriented at an angled relationship with respect to the second cathode plate, wherein the second cathode blocking shield defines an angle of at least 10 degrees and not more than 80 degrees with respect to a plane parallel to the second cathode plate, wherein the second cathode blocking shield extends along one edge of the second cathode plate.

4. The ion pump of claim 1, wherein the blocking shield assembly further comprises:

at least one inlet blocking shield positioned immediately adjacent to the gas inlet, wherein the inlet blocking shield is configured to block particles from transmission through the gas inlet from surfaces within the housing that have a line-of-sight path to the cathode, wherein the inlet blocking shield does not block particles generated at the cathode from line-of-sight transmission through the gas inlet.

5. The ion pump of claim 4, wherein the inlet blocking shield includes at least one portion that is angled at least 10 degrees and not more than 170 degrees with respect to a plane that is perpendicular to the direction of flow through the gas inlet.

6. The ion pump of claim 4, wherein the inlet blocking shield comprises one or more portions spaced surrounding the gas inlet.

7. The ion pump of claim 1, wherein the blocking shield assembly defines an opening allowing line-of-sight transmission from at least a portion of the gas inlet to at least a portion of the anode.

8. The ion pump of claim 1, wherein the blocking shields are electrically grounded.

9. An ion pump comprising:

a housing containing an anode and cathode; and a blocking shield assembly within the housing configured to block particles generated at the cathode from line-of-sight transmission out of the housing and further configured to block line-of-sight transmission out of the housing of particles generated at or reflected from surfaces within the ion pump that have a line-of-sight path to the cathode.

10. The ion pump of claim 9, wherein the cathode comprises a first plate positioned on one side of the anode and spaced apart from the anode and a second plate positioned on an opposite side of the anode and spaced apart from the anode and wherein the blocking shield assembly further comprises:

a first cathode blocking shield oriented at an angled relationship with respect to the first cathode plate, wherein the first cathode blocking shield defines an angle of at least 10 degrees and not more than 80 degrees with respect to a plane parallel to the first cathode plate, wherein the first cathode blocking shield extends along one edge of the first cathode plate.

11. The ion pump of claim 10, wherein the blocking shield assembly further comprises:

a second cathode blocking shield oriented at an angled relationship with respect to the second cathode plate, wherein the second cathode blocking shield defines an angle of at least 10 degrees and not more than 80 degrees with respect to a plane parallel to the second cathode plate, wherein the second cathode blocking shield extends along one edge of the second cathode plate.

12. The ion pump of claim 9, wherein the blocking shield assembly further comprises:

at least one inlet blocking shield positioned immediately adjacent to the gas inlet, wherein the inlet blocking shield is configured to block particles from transmission through the gas inlet from surfaces within the housing that have a line-of-sight path to the cathode, wherein the inlet blocking shield does not block particles generated at the cathode from line-of-sight transmission through the gas inlet.

13. The ion pump of claim 12, wherein the inlet blocking shield includes at least one portion that is angled at least 10 degrees and not more than 170 degrees with respect to a plane that is perpendicular to the direction of flow through the gas inlet.

14. The ion pump of claim 12, wherein the inlet blocking shield comprises one or more portions spaced surrounding the gas inlet.

15. The ion pump of claim 9, wherein the blocking shield assembly defines an opening allowing line-of-sight transmission from at least a portion of the gas inlet to at least a portion of the anode.

16. The ion pump of claim 9, wherein the blocking shields are electrically grounded.

* * * * *